US006216711B1

(12) United States Patent
Ormanoski

(10) Patent No.: US 6,216,711 B1
(45) Date of Patent: Apr. 17, 2001

(54) HAND HELD SUN SHIELD

(76) Inventor: Edward Ormanoski, 1960 Greenwood Rd., Allentown, PA (US) 18103

( * ) Notice: Subject to any disclaimer, the term of this patent is extended or adjusted under 35 U.S.C. 154(b) by 0 days.

(21) Appl. No.: 09/419,844

(22) Filed: Oct. 19, 1999

(51) Int. Cl.[7] ..... A45B 3/00
(52) U.S. Cl. ..... 135/16; 135/900
(58) Field of Search ..... 135/902, 900, 135/95, 16, 96; 297/184.15, 184.1

(56) References Cited

U.S. PATENT DOCUMENTS

| | | | | |
|---|---|---|---|---|
| Re. 22,796 | | 10/1946 | Husted . | |
| D. 202,603 | | 10/1965 | Hyodo . | |
| D. 247,580 | | 3/1978 | Hannon . | |
| D. 266,385 | | 10/1982 | Musgrove et al. . | |
| D. 347,726 | | 6/1994 | Mantenuto . | |
| 486,322 | * | 11/1892 | Brouwer, Jr. | 135/95 X |
| 669,648 | | 3/1901 | Linesch . | |
| 946,078 | | 1/1910 | Sprinzel . | |
| 1,231,104 | | 6/1917 | Waggoner . | |
| 1,288,872 | | 12/1918 | Gray . | |
| 1,652,973 | | 12/1927 | Bowers . | |
| 1,807,686 | * | 6/1931 | Bright | 135/16 |
| 2,079,048 | | 5/1937 | Spencer . | |
| 2,122,901 | | 7/1938 | Urbanek . | |
| 2,417,194 | | 3/1947 | Gross . | |
| 4,082,102 | * | 4/1978 | Heuer | 297/184.1 X |
| 4,300,798 | * | 11/1981 | Musgrove et al. | 297/184.15 |
| 4,911,611 | | 3/1990 | Moore . | |
| 5,000,210 | * | 3/1991 | Worthingon, Jr. | 297/184.15 X |
| 5,013,085 | * | 5/1991 | Craig | 297/184.15 |
| 5,301,999 | * | 4/1994 | Thompson et al. | 297/184.15 X |
| 5,397,268 | * | 3/1995 | Chang et al. | 297/184.1 X |
| 5,441,067 | * | 8/1995 | James et al. | 297/184.15 X |
| 5,638,849 | * | 6/1997 | Scott | 297/184.15 X |

* cited by examiner

*Primary Examiner*—Jose V. Chen
(74) *Attorney, Agent, or Firm*—Ratner & Prestia

(57) ABSTRACT

A hand held sun shield having a frame curved by or curving within the frame a material adapted to reflect or filter ultraviolet radiation. The sun shield includes a handle adapted to position the frame at many angular relationships parallel or perpendicular to the handle.

20 Claims, 5 Drawing Sheets

HAND HELD SUN SHIELD

CROSS REFERENCE TO RELATED APPLICATIONS

Not applicable

STATEMENT REGARDING FEDERALLY SPONSORED RESEARCH OR DEVELOPMENT

Non Applicable

BACKGROUND OF THE INVENTION

The present invention pertains to hand held devices for protecting a user from the harmful effects of ultraviolet radiation from the sun.

A significant medical problem in the United States and in the world, is the increase of the incidents of skin cancer. The ozone layer surrounding the earth is suppose to block out harmful ultraviolet radiation from the sun. However, it is common knowledge that the ozone layer is becoming thinner each year and in point of fact, there are certain locations around the globe were the ozone layer has completely disappeared. The occurrence of melanoma type cancers had a significant increase having doubled in the past 20 years.

During the course of a year, and especially during the warm summer months, individuals that tend to participate in a number of outdoor activities, which range from athletic type endeavors in which the person participates, participation as a spectator in outdoor events such as baseball games and tennis matches and merely resting in the warm sun, such as on a beach or at a lake.

According to the American Cancer Society and others, people engaging in outdoor activities during the summer months and, for that matter the entire year, are encouraged to cover as much as the unprotected portion of the exposed skin from direct contact with sunlight. One method of accomplishing this is to wear head covering and neck covering, the most vulnerable or exposed portion of the human anatomy, especially during participation of a spectator sport, are the head, face, and back of the neck, assuming normal attire is worn.

It is not always possible to have a hat, which covers the exposed portions of the anatomy that are most vulnerable. Therefore, people have resorted to using a hand held sun shade or sun shield devices to accomplish this task. One such device is a combined fan and sun shade shown in U.S. Pat. No. 946,078 or U.S. Pat. No. 4,911,611.

A number of fan like devices could be used for this same purposes. Illustrative of such fans are U.S. Pat. Nos. 689, 648; 2,122,901; and 2,417,194; Re 22,796 as well as Design Patents 202,603; 247,580; 266,385; and 347,726.

BRIEF SUMMARY OF THE INVENTION

A light weight sun shield can be achieved by combining a frame, which is adapted to hold a material which is adapted to reflect or filter out ultraviolet radiation in combination with a handle that can be positioned at an angular relationship either perpendicular to or parallel with the frame. The handle is adapted for positioning at any desired angular relationship to the frame so that the sun shield can be hand held or other wise positioned relative to the body of a user to screen harmful radiation from exposed portions of the users anatomy. Thus, in one aspect, the present invention is a hand held sun shield for protecting a user from the harmful effects of sunlight comprising in combination; a shade portion consisting of a frame having a generally rectangular shape and defining a central open portion, the open portion closed by a material adapted to reflect ultraviolet radiation from sunlight, means on the shade portion to position handle at one of perpendicular, parallel, or both perpendicular and parallel to the central open portion of the frame the means further adapted to permit a user to position the handle at an angular relationship to the frame when parallel to or perpendicular to the frame, and a removable handle for attachment to the means on the shade portion of the sun shield.

In another aspect the sun shield according to the present invention utilizes threaded studs and balls or threaded apertures and a threaded portion of the handle to attach the handle to the sun shade.

In another aspect, the present invention permits attachment means of the handle to the sun shade to be positioned around the periphery of the frame portion at different locations to effect optimum positioning of the frame for protection of the user.

DESCRIPTION OF THE INVENTION

Figures 1, 2:
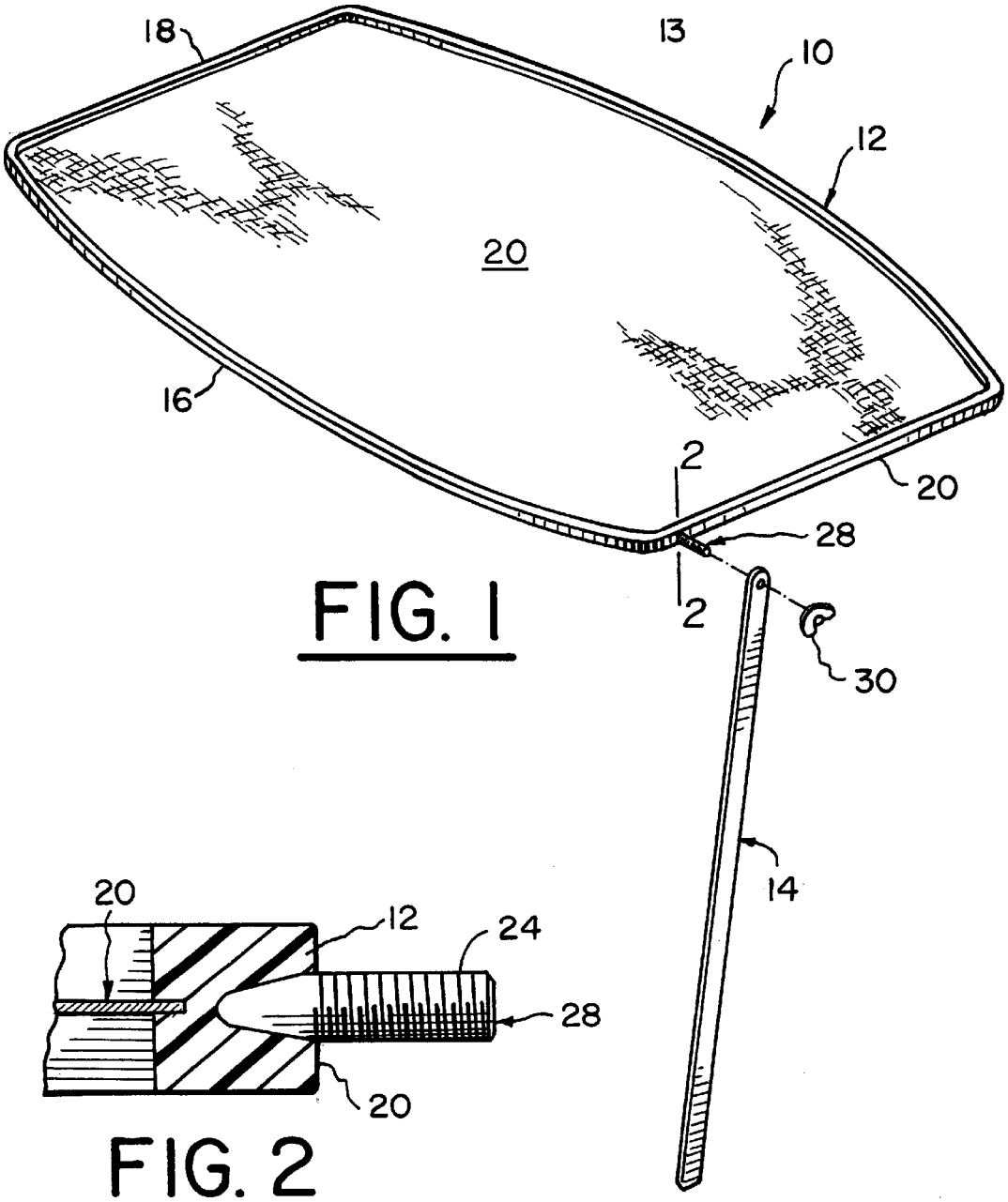
FIG. 1 is an exploded perspective view of a device according to the present invention.
FIG. 2 is an enlarged partially fragmentary cross sectional view showing one means for attaching the handle to the frame.

Referring to FIG. 1, a sun shield device according to the present invention is shown generally as 10. Sun shield device 10 includes a frame portion 12 and a handle 14. The frame 12 has a generally rectangular shape with a pair of long sides 14, 16, and pair of shorter sides 18, 20. While the generally rectangular shape is preferred with the long sides 14, 16 being curved, other shapes are within the scope of the present invention. For example, the frame can be completely circular or square or a perfect rectangle with straight sides. Frame 12 is adapted to hold a material 20, which will reflect or filter ultraviolet rays emitted by sunlight. The material 20 can be a light weight canvas of a light color or a mesh that is adapted for the purpose of filtering out or reflecting ultraviolet radiation. As shown in FIG. 2, the material 20 can be held by the frame 12. Alternatively, the material 20 can be fitted over the frame 12 in the form of a cover. In either case, the material 20 should be stretched by the frame to resemble the head of an acoustic drum. Frame 12 includes a stud 22 which contains threads 24 adapted to receive a nut or wing nut 26. As shown in FIG. 2, the stud 22 can be fastened to the frame 12 by any known means, the means being dictated by the materials of construction. For example, if the frame 12 is plastic, the stud can be fastened to a suitable aperture in the frame by heat staking, adhesives or the like.

The sun shield 10 includes a handle 14 having an aperture 26 on one end. The aperture 26 is of a size to easily slip over the stud 22 so that the handle can be positioned at a right angle to the frame 10.

Figure 3:
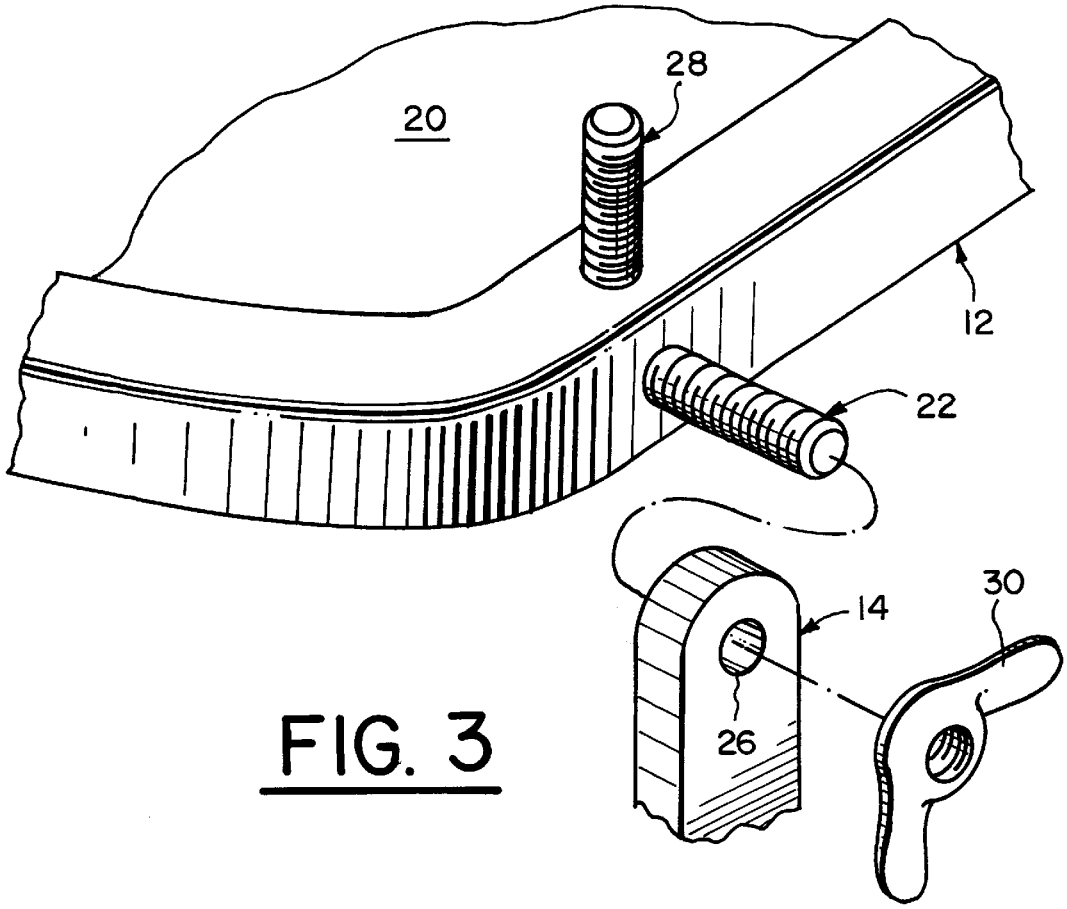
FIG. 3 is an enlarged fragmentary perspective view illustrating dual attachment means for the handle to the frame of a sun shield according to the present invention.
Figure 4:
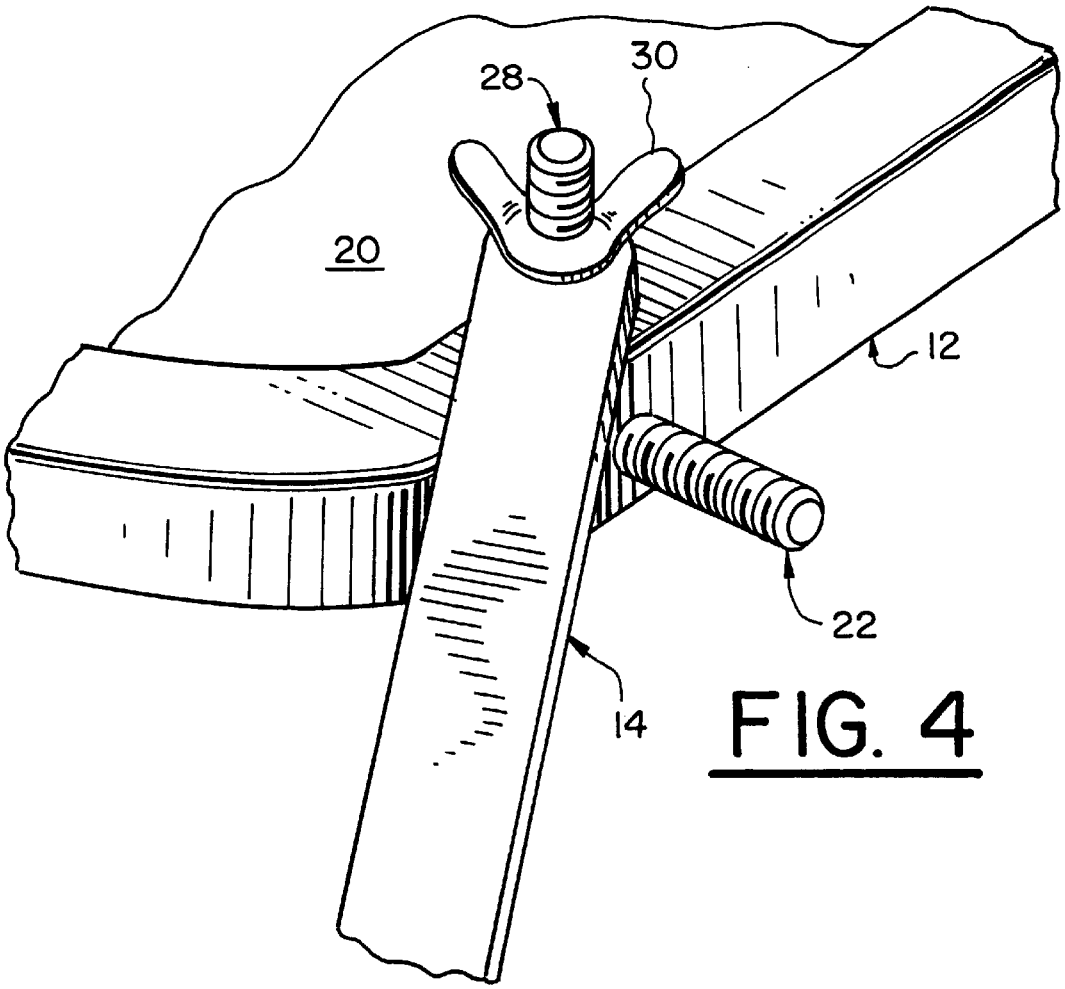
FIG. 4 is an enlarged fragmentary perspective view similar to FIG. 3 showing the handle positioned parallel to the frame.

Referring to FIG. 3, the frame 22 can be fitted with a second stud 28 having a threaded surface similar to stud 22 with stud 28 being positioned on the frame 12 perpendicular to the stud 22. The handle 14 is shown in the exploded position for attachment to the stud 22 in FIG. 3. FIG. 4 shows the handle 14 positioned on stud 28 and held thereto by nut 26 so that the handle 14 is parallel to the frame 12. In this position the handle can be rotated so that it is parallel with the long side of the shade for easy storage.

With the handle positioned on either stud 22 or 28 the handle 14 can be locked in various angular positions so that the user can tilt or position the shade to achieve the maximum coverage of the material portion 20 against the user's exposed skin. The handle 14 can be positioned over the shoulder of the user, held by the clothing of the user or clamped to a convenient railing or the like. The sun shield 10 can be used to protect infants in strollers by fixing the sun shield to a portion of the stroller that is adapted to hold the handle 14 of the sun shield 10.

Alternatively, the handle 14 could be fitted with a stud in aperture 26 with the stud projecting outwardly of the handle and having a threaded portion. Studs 22 and 28 on the frame 12 would be replaced by suitable apertures containing internal threads complementary to the thread on the projecting stud on handle 14. In this embodiment the handle could be positioned either perpendicular to or parallel to the frame and the handle could be removed for carrying in a position disposed over the frame.

In either embodiment the handle portion could be equal to, shorter than, and/or longer than the long side of the frame 12.

In one embodiment the frame could be constructed from well known plastic materials with a rectangular shape 15 inches by 12 inches. The handle 14 could be 15 inches long. The handle and the nut 26 would also be made of structural plastic materials and the fabric or shade portion 20 could be made from a tightly fitted light color canvas that would reflect or filter out the ultraviolet radiation.

Figure 5:
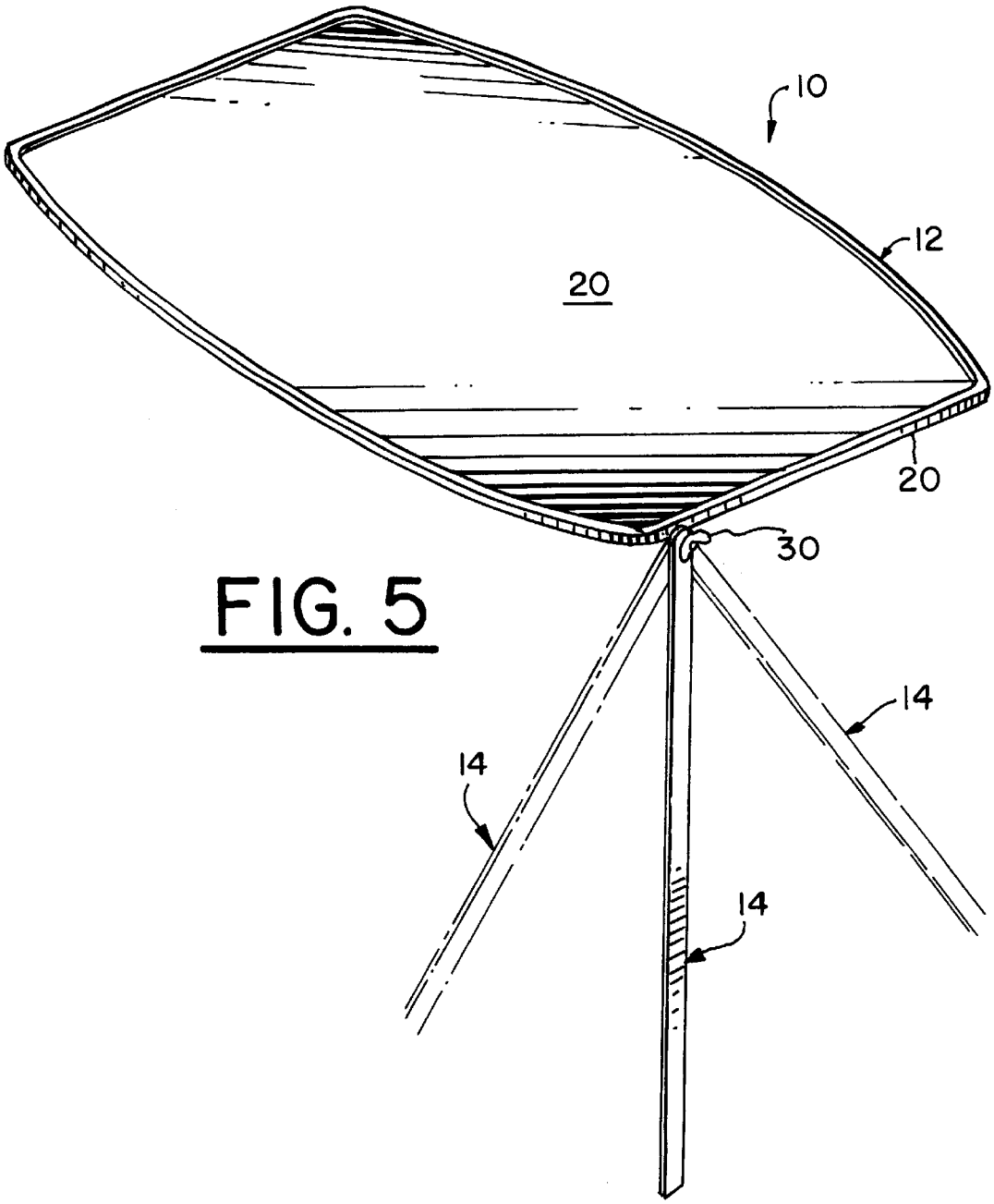
FIG. 5 is a perspective view showing angular positioning of the handle relative to the frame were the handle is disposed perpendicular to the frame.

Referring to FIG. 5, there is shown a sun shield 10 with only the stud 22 for purposes of illustration of the handle of the variable positioning of the handle 14. As shown in FIG. 5, the handle 14 can be moved from a position at right angles to the frame 12 to any angular position from 0°–90° relative to the frame so that the sun shield can be positioned at an infinite number of angles.

Figure 6:
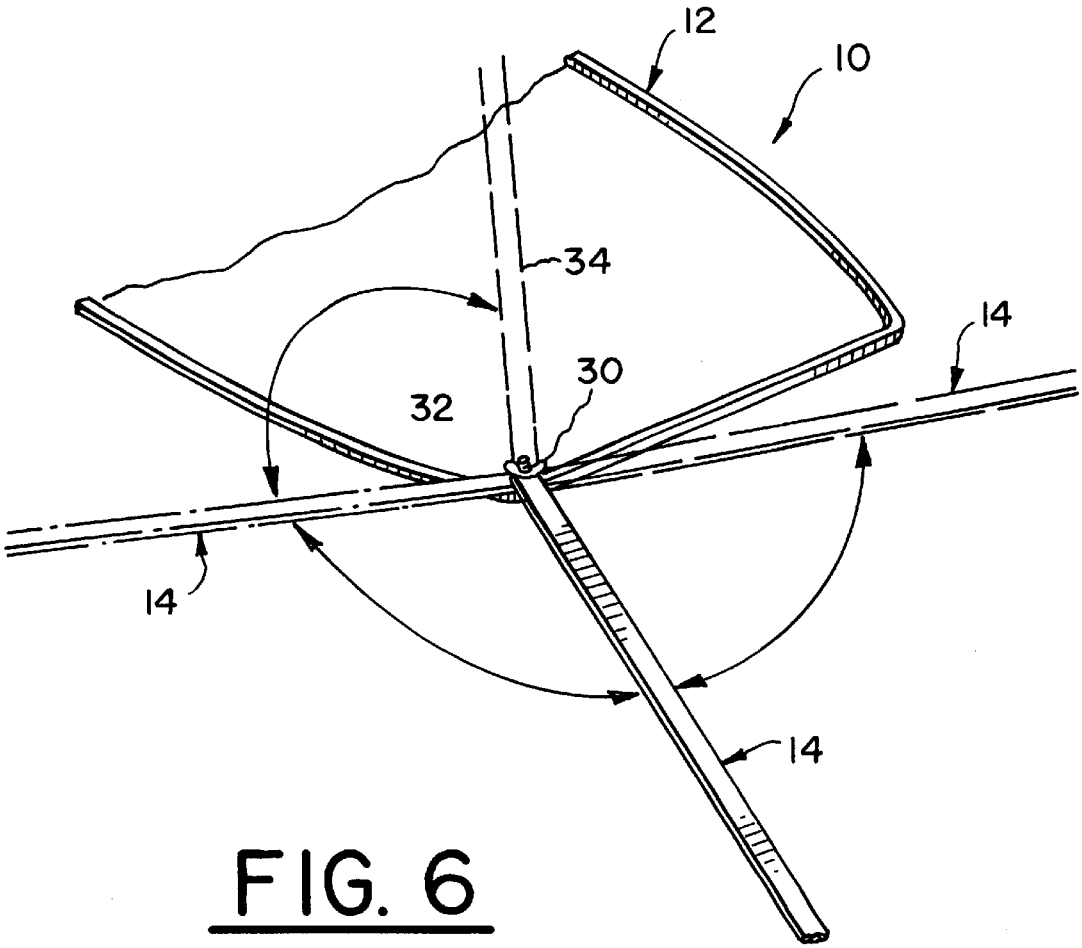
FIG. 6 is a fragmentary perspective view showing variable positioning of the handle were the handle is fastened parallel to the frame.

FIG. 6 shows the sun shield 10 with a stud 30 positioned perpendicular to the frame at a corner of the frame. The stud 30 permits the handle 14 to be rotated at any angular relationship to a line generally perpendicular to the side 20 of the frame 12. In this matter, the handle 14 can be positioned at various angular relationships for maximizing the sun shielding ability. For storage or transport, the handle 14 can be moved to the position shown generally as 32 which would position the handle across the frame making it possible for the user to put the sun shield inside of a carrying bag, tote or the like.

The embodiment shown in FIG. 6 can include a stud perpendicular to the stud 30 on the corner of the frame so that the handle can be positioned either perpendicular or parallel to the frame 12.

The sun shade device according to the present invention can be used to not only shade the user from the sun, but to protect the user from the harmful effects of the suns rays. It is generally accepted that the largest cause of skin cancer is overexposure to sunlight which can cause the appearance of melanoma which is the most serious of the skin cancers. Melanomas can begin as a mole or other dark spot in the skin. It appears that the ultraviolet rays of the sun trigger a reaction that causes the melanoma to appear. The most effective way to prevent melanoma is to avoid exposure to sunlight. The device of the present invention enables the user to participate in activity normally conducted in the outdoors where the user is exposed to sunlight and enables the user to block out the harmful effects of the suns rays without diminishing the users enjoyment of outdoor activity.

Having thus described my invention was desired to be secured by letters patent of the United States as set forth in the appended claims.

What is claimed:

1. A hand-held sun shield for protecting a user from the harmful effects of sun light comprising in combination:

a shade portion consisting of a frame having a generally rectangular shape and defining a central open portion, said open portion closed by a material adapted to reflect ultraviolet radiation from said sun light;

means on said shade portion being one of two studs positioned perpendicular to each other or two apertures positioned perpendicular to each other on one of a shorter side of said frame or a corner of said frame to position a handle at one of perpendicular, parallel or both perpendicular and parallel, to said central open portion said frame, said means further adapted to permit the user to position said handle at an angular relationship to said frame when parallel to or perpendicular to said frame, and a removable handle for attachment to said means on said shade portion.

2. A sun shield according to claim 1 wherein said means on said shade portion includes two studs positioned perpendicular to each other on a shorter side of said frame.

3. A sun shield according to claim 2 wherein said handle has an aperture at one end to fit over said studs, and means to hold said handle in a fixed position on said studs.

4. A sun shield according to claim 3 wherein said studs are threaded and said means to hold said handle includes a suitably threaded nut.

5. A sun shield according to claim 1 wherein said means on said shade portion includes two apertures positioned perpendicular to each other in a shorter side of said frame.

6. A sun shield according to claim 5 wherein said handle has an end portion having a shape adapted to removably and frictionally engage said apertures.

7. A sun shield according to claim 6 wherein said apertures on said frame contain internal threads and said end portion of said handle adapted to threadably engage said threaded apertures.

8. A sun shield according to claim 1 wherein said material adapted to reflect ultraviolet radiation is a lightweight light colored canvas.

9. A sun shield according to claim 1 wherein said shade portion is a generally rectangular shaped frame.

10. A sun shield according to claim 9 including material closing said open portion of said frame positioned by one of fastened, inside said frame or a cover fitted over said frame, said material being fitted to or over said frame to resemble a drum head.

11. A hand-held sun shield for protecting a user from the harmful effects of sun light comprising in combination:

a shade portion consisting of a frame having a generally rectangular shape and defining a central open portion, said, open portion closed by a material adapted to reflect ultraviolet radiation from said sun light;

two studs positioned perpendicular to each other on a shorter side of said frame to position a handle at one of perpendicular, parallel or both perpendicular and parallel, to said central open portion of said frame, said means further adapted to permit the user to position said handle at an angular relationship to said frame when parallel to or perpendicular to said frame, and a removable handle for attachment to said means on said shade portion.

12. A sun shield according to claim 11 wherein said handle has an aperture at one end to fit over said studs and means, to hold said handle in a position on said studs.

13. A sun shield according to claim 12 wherein said studs are threaded and said means to hold said handle includes a suitably threaded nut.

14. A hand-held sun shield for protecting a user from the harmful effects of sun light comprising in combination:

a shade portion consisting of a frame having a generally rectangular shape and defining a central open portion, said, open portion closed by a material adapted to reflect ultraviolet radiation from said sun light;

two apertures positioned perpendicular to each other in a shorter side of said frame to position a handle at one of perpendicular, parallel or both perpendicular and parallel, to said central open portion of said frame, said means further adapted to permit the user to position said handle at an angular relationship to said frame when parallel to or perpendicular to said frame, and a removable handle for attachment to said means on said shade portion.

15. A sun shield according to claim 14 wherein said handle has an end portion adapted to removably and frictionally engage said apertures.

16. A sun shield according to claim 14 wherein said apertures in said frame contain internal threads and said end portion of said handle is adapted to threadably engage said threaded apertures.

17. A sun shield according to claim 11 wherein said material adapted to reflect ultraviolet radiation is a lightweight light colored canvas.

18. A sun shield according to claim 11 wherein said shade portion is a generally rectangular shaped frame.

19. A sun shield according to claim 11 wherein material closing said open portion of said frame is positioned by one of held inside said frame or a cover over said frame said material being fitted to resemble a drum head.

20. A sun shield according to claim 14 wherein material closing said open portion of said frame is positioned by one of held inside said frame or a cover over said frame said material being fitted to resemble a drum head.

* * * * *